US006655927B2

(12) United States Patent
Herrmann et al.

(10) Patent No.: US 6,655,927 B2
(45) Date of Patent: Dec. 2, 2003

(54) RADIAL PISTON PUMP WITH PISTON ARRANGEMENT FOR CONTROLLING INLET/EXIT FLOW

(75) Inventors: Michael Herrmann, Lebach (DE); Wolfgang Rapp, Neukirch (DE)

(73) Assignee: ZF Batavia LLC, Batavia, OH (US)

( * ) Notice: Subject to any disclaimer, the term of this patent is extended or adjusted under 35 U.S.C. 154(b) by 0 days.

(21) Appl. No.: 10/052,026

(22) Filed: Jan. 18, 2002

(65) Prior Publication Data

US 2002/0136644 A1 Sep. 26, 2002

(30) Foreign Application Priority Data

Jan. 24, 2001 (DE) ..... 101 03 014

(51) Int. Cl.[7] ..... F04B 1/04

(52) U.S. Cl. ..... 417/273; 417/546; 91/491; 92/72

(58) Field of Search ..... 417/273, 523, 417/546, 547; 91/491; 92/72

(56) References Cited

U.S. PATENT DOCUMENTS

| | | | | | |
|---|---|---|---|---|---|
| 2,687,615 | A | * | 8/1954 | Morrow | 60/52 |
| 3,012,509 | A | | 12/1961 | Mercier | 103/37 |
| 3,827,831 | A | * | 8/1974 | Lines | 417/273 |
| 5,100,305 | A | * | 3/1992 | Zirps | 417/521 |
| 5,213,482 | A | * | 5/1993 | Reinartz et al. | 417/273 |
| 5,338,160 | A | * | 8/1994 | Thurner | 417/273 |
| 5,645,406 | A | | 7/1997 | Rowe et al. | 417/273 |
| 5,895,207 | A | * | 4/1999 | Burgdorf et al. | 417/410.1 |

FOREIGN PATENT DOCUMENTS

| | | | | |
|---|---|---|---|---|
| DE | 3610774 | C1 | * | 4/1987 |
| DE | 0430099 | A1 | * | 6/1991 |
| DE | 41 39 611 | A1 | | 6/1993 |
| DE | 44 25 929 | A1 | | 1/1996 |
| DE | WO-97/05381 | | * | 2/1997 |
| DE | 199 04 926 | A1 | | 8/2000 |
| FR | 2818704 | A1 | * | 6/2002 |
| GB | 1 411 978 | | | 10/1975 |
| JP | 405302566 | A | * | 11/1993 |
| JP | 405302567 | A | * | 11/1993 |
| JP | 406026443 | A | * | 2/1994 |

* cited by examiner

*Primary Examiner*—Cheryl J. Tyler
*Assistant Examiner*—John F Belena
(74) *Attorney, Agent, or Firm*—Davis & Bujold, PLLC

(57) ABSTRACT

The radial piston pump possesses a pump housing in which a plurality of cylinder bores are provided having pump pistons placed therein which can be driven by a cam. Further, an arrangement is provided in each pump piston (3) wherein the inlet or the outlet, or both the inlet as well as the outlet of the fluid in each cylinder bore, is controlled.

14 Claims, 3 Drawing Sheets

RADIAL PISTON PUMP WITH PISTON ARRANGEMENT FOR CONTROLLING INLET/EXIT FLOW

FIELD OF THE INVENTION

The present invention concerns a radial piston pump with a pump housing, in which a plurality of cylinder bores are made in which pump pistons are inserted, which pistons can be driven by a cam.

BACKGROUND OF THE INVENTION

Radial piston pumps of many types are widely known. Thus, DE 41 39 611 describes a radial piston pump, the pump pistons of which pull in oil through a suction opening on the upper rim joined to an annular channel. The pressure pulsations in the suction channel, caused by the pump pistons, engender an uneven filling of the piston spaces. Further, a reversal in the flow direction, which again causes an unequal filling of the pistons arises in the said annular channel, dependent on respective pump pistons.

Beyond these disadvantages, the conventional radial piston pumps give rise to noise, because of inherent operating principles, which has proven disturbing when radial piston pumps are used as an oil-pump in a transmission for motor vehicles.

In order to lessen this buildup of noise, the applicant already has proposed a radial piston pump in DE 44 25 929 with a plurality of pump pistons arranged in star shape around a cam, whereby storage spaces are apportioned for the pistons, which said storage spaces are in communication with an annular channel. Thereby, each piston receives non-turbulent oil in the suction line from the said storage space. This contributes to an equal filling of the piston space being achieved at a low level of noise. The interconnection of the said storage spaces between one another allows the installation of only one suction intake, because the same suction relationship has been created at the predetermined oil supply inlet for each piston. A radial piston pump of this kind is especially well adapted for an automatic transmission of a passenger car, wherein the said pump would be placed immediately after the hydrodynamic converter. A cam is installed, as a drive element for the radial piston pump, to turn on the hollow shaft of the converter, whereby the pistons in the radial piston pump are held by the force of compressive springs with their piston bases contacting a slip ring. The pistons slide in the cylinder bores in the pump body, wherein the said cylinder bores are closed by plugs. Each plug has as an exit vent from the pressure chamber, this being a bore, on which a band spring encircling the pump places a closure pressure. The band spring seals the bores from the collection space, which communicates with one or more using apparatuses.

The purpose of the present invention is to design a radial piston pump, for the transmission of a motor vehicle, so that no objectionable sound or pressure pulsations occur.

Basing considerations on a radial piston pump of the kind more precisely defined in the introductory passages, this purpose is achieved by the features provided in claim 1. Advantageous embodiments are described in the subordinate claims.

SUMMARY OF THE INVENTION

The invention further provides that an arrangement has been made in the pump pistons which controls both the inlet as well as the outlet of the fluid, that is in or out of each cylinder bore.

By means of the placement of an inlet and an outlet control within the pumping cylinders, the pressure peaks, which up to now have been occurring and which make themselves felt in the collection space, are now prevented or very greatly reduced. In the case of the previously known radial piston pumps with a valve band, a pressure peak must inherently be generated in the cylinder bore, in order to open the valve band against the existing outer pressure. Contrary to this, with the present invention, an effect of accelerating and decelerating on the part of the components within the pump pistons in the form of a check valve is applied so that an inlet and outlet control is formed, which is now largely independent of the pressure relationships inside and outside of the cylinder bore.

A further advantage, which is achieved with the radial piston pump designed in accord with the invention, is that the build up of pressure in the cylinder bore generates itself more quickly since inflow, at the suction intake, is uniform over the entire suction stroke and that, in the case of the subsequent pressure stroke, the inlet is immediately closed, that is to say is more quickly closed than is the case for the previously known radial piston pumps with a slot control.

BRIEF DESCRIPTION OF THE DRAWINGS

The invention will now be described, by way of example, with reference to the accompanying drawings in which.

DETAILED DESCRIPTION OF THE INVENTION

Figure 1:
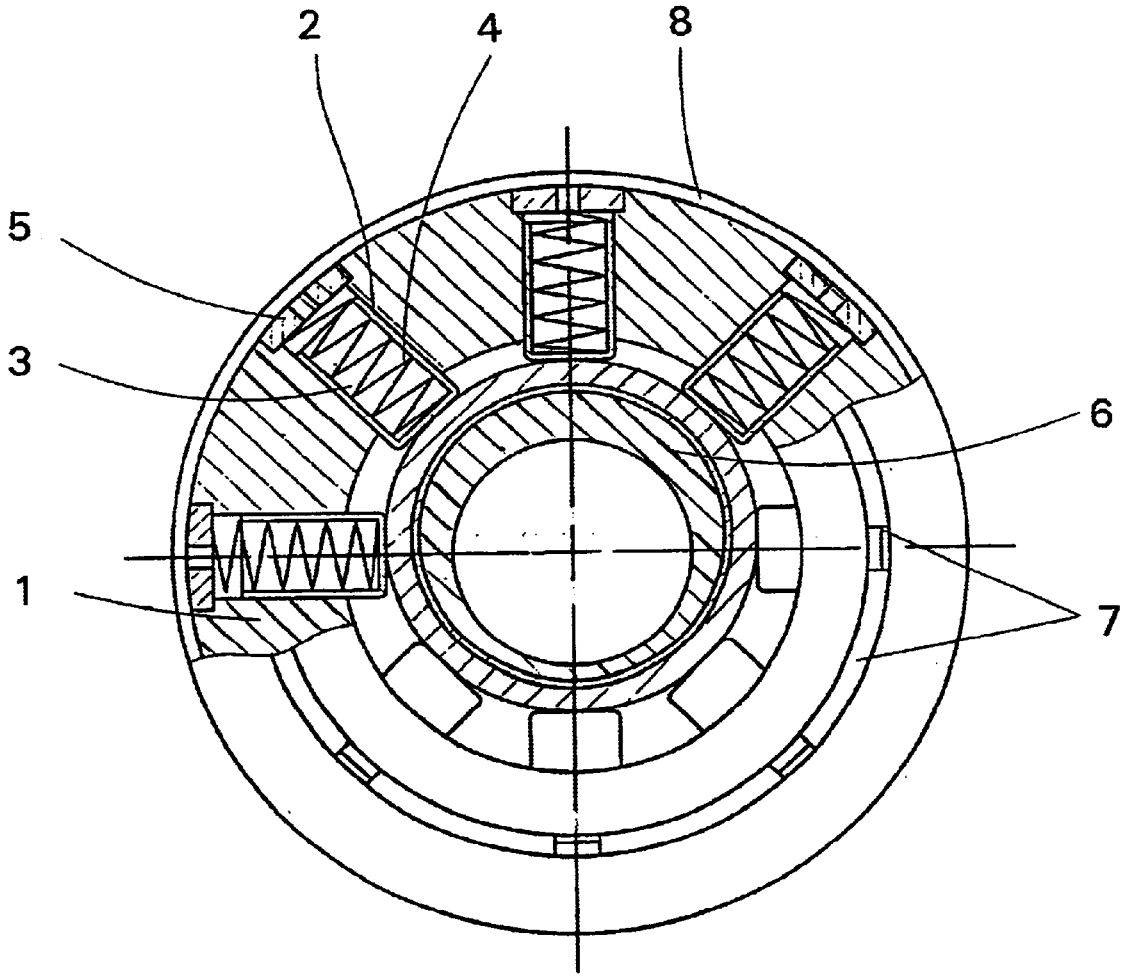
FIG. 1 shows a section through a conventional radial piston pump.

FIG. 1 shows, in a schematic manner, the construction of a conventional radial piston pump, wherein the pump body is designated by the following reference numbers:

1 pump body
2 cylinder bores, a plurality thereof in the body 1
3 pistons, set in the cylinder bores 2
4 springs, loading said pistons 4
5 valve plugs
6 a cam, driving said pistons 4
7 annular channel, and
8 band spring to close the opening in the plug 5.

The annular channel 7 is utilized for the control of the suction feed for the oil and communicates with all of the cylinder bores to unite them on their suction side.

A radial piston pump of this conventional design produces substantial noise, even at a complaint level, which arises first from the lifting of the circumferential valve band 8, and second from the necessary pressure peaks required for said lifting, which peaks occur in the respective pistons 3. The pressure peaks have been detected in the form of pulsations in the collection chamber or storage space for the pressurized fluid.

In accord with the invention, provision has now been made for an arrangement for each pump piston 3 which controls both the inlet as well as the outlet of the fluid, as it flows either in or out of the respective cylinder bore 2.

Figure 2A:
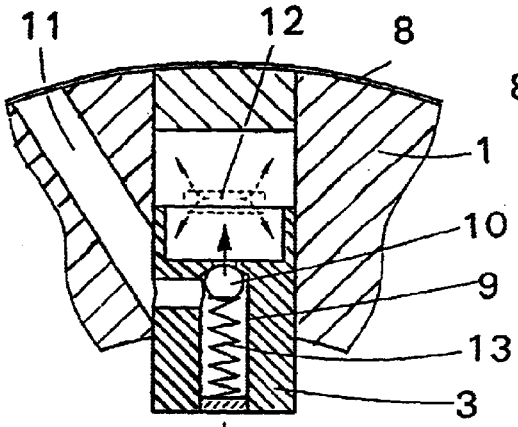
FIGS. 2*a,* 2*b* show partial sections through a first embodiment in accord with the invention, once during the suction stroke and once during the pressure stroke.
Figure 2B:
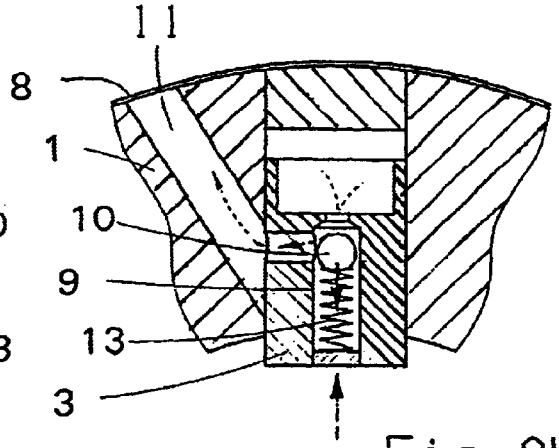

FIGS. 2*a* and 2*b* show a first embodiment of the arrangement of this kind whereby, in FIG. 2*a,* the piston 3 is in the suction stroke position and, in FIG. 2*b,* the piston is in the pressure stroke phase. For this purpose, a passage 9 has been provided within the piston 3, which communicates with the inlet 12 and in a given position of the piston 3 with the outlet 11. A ball 10, loaded by a spring 13, is inserted in this passage 9 which, in accord with the direction of the pumping, closes or opens the connection between the inlet and the outlet. The ball movement direction is depicted by a full line. If the piston 3 moves itself, as is indicated by the dashed line in FIG. 2*a,* during the intake suction stroke downward, then the ball, governed by its inertia and supported by the spring 13, is pressed against its seat and seals off any flow. Thereby, the piston 3 can induce suction to bring oil out of the suction channel 12. For the sake of clarity, in FIGS. 2*a,* 2*b,* (and correspondingly so in the later descriptions of FIGS. 3*a,* 3*b,* 4*a,* 4*b,* 6 and 7) the direction of oil flow is depicted by a dashed line. In the case of subsequent motion of the piston 3, this time upward during the pressure stroke again indicated by a dashed line as is shown in FIG. 2*b,* the ball 10 rises by its inertia from its seat and the fluid, i.e., the oil, can be pumped to the outside through the outlet 11. The inertia of the ball 10 (the function of which another appropriate component could be employed) is still supported in its retraction by the pressure which is generated in the piston space due to the pressure stroke, that is upon a suction stroke by the externally remaining pressure in the direction of pressure against the seat. The ball 10, accordingly, acts like a check valve.

The manner of functioning of the ball 10 can be adjustable, within certain limits, by its weight and its size.

Figure 3A:
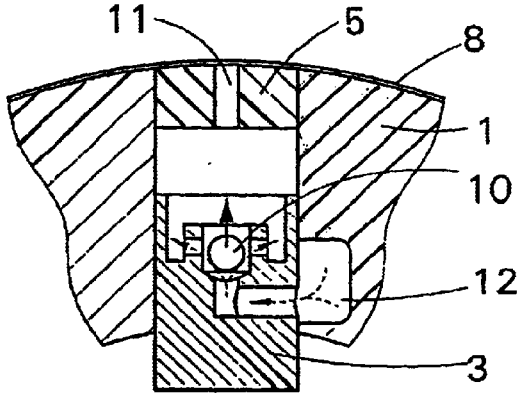
FIGS. 3*a,* 3*b* show partial sections through a second embodiment in accord with the invention, likewise once during the suction stroke and once during the pressure stroke.

It is also possible, as is seen in FIGS. 3*a,* 3*b,* to operate with no compression spring for the ball 10 since, by corresponding measurement, its weight and inertia can be made to suffice for the desired function. A compression spring 13 supports the ball—or the corresponding component—in its function, however, in accord with the location of its installed position.

Figure 3B:
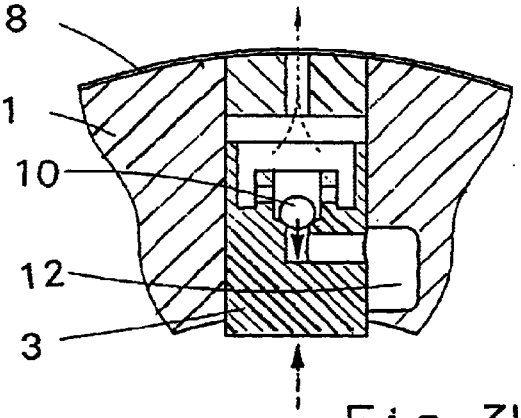

The desired function of outlet control can also be used for inlet control, wherein the function of the check valve ball in accord with FIGS. 3*a* and 3*b,* but in a reverse order. This means that upon the intake suction stroke, (FIG. 3*a*) the ball 10 opens the connection between inlet and outlet and, upon the pressure stroke, (FIG. 3*b*) closes the same. (Note the movement direction of the piston by the dashed line and the ball by the full line.)

As experiment has shown, the invented radial piston pump is particularly advantageous for pressure buildup in the piston during a cold starting run of the pump since, by means of the entire suction stroke, the fluid can be pulled in by suction and upon the subsequent pressure stroke, the inlet is immediately closed, which is contrary to the formerly used slot control.

Figure 4A:
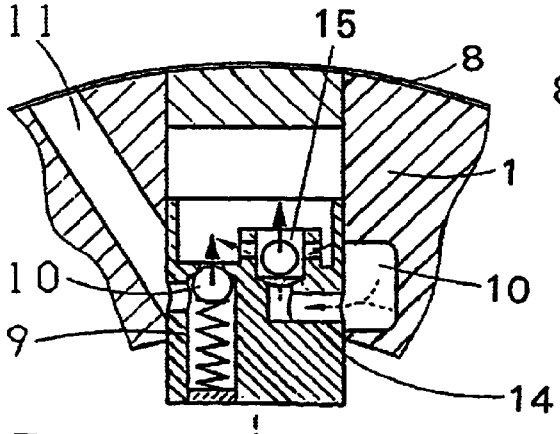
FIGS. 4*a,* 4*b* show partial sections through a further embodiment of a radial piston pump in accord with the invention.
Figure 4B:
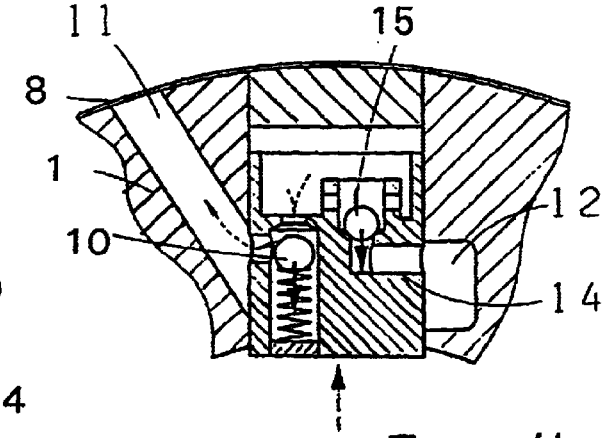

FIGS. 4*a* and 4*b* show an embodiment in which both the inlet control as well as the outlet control is inserted into a single pump piston 3. This means that two passages 9, 14, separate from one another, are provided within the piston, from which one serves as the outlet control, in accord with FIG. 2, and the other follows as the inlet control in accord with FIG. 3, whereby two balls 10, 15 are respectively provided in the two passages 9, 10. (Note the motion direction of the piston by dashed lines and the ball motion shown by solid lines.)

Figure 5:
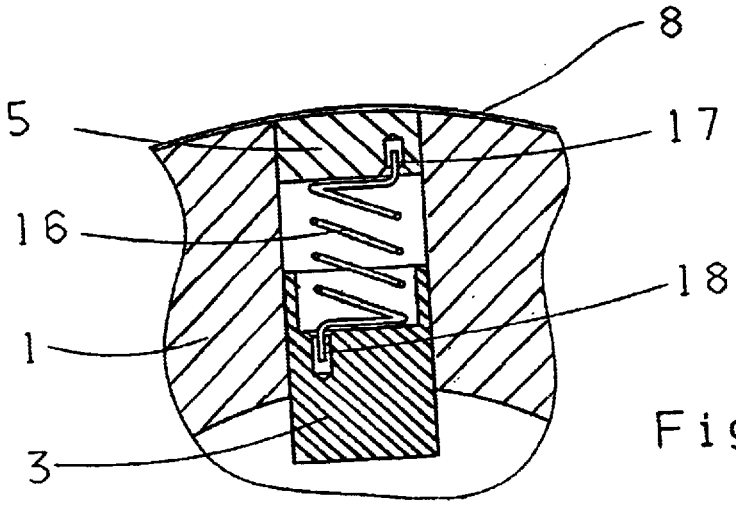
FIG. 5 shows a security to prevent twist for the pump piston.

In order to prevent, in the case of the invented radial piston pump, that the pump piston 3 rotates itself about its axis in the cylinder bore 2, whereby the inlet/outlet openings would switch, by an advantageous embodiment shown in FIG. 5, a twist prevention device, in the form of a coil piston spring 16 which exhibits anchorage pins 17, 18 on both ends which, for example, can be made by a simple bending of the ends of the said spring 16 is provided. The one end 18 of the coil spring 16 engages with a bore in the piston 3, while the other end 17 of the coil piston spring anchors itself in a bore in the pump housing 1 or in the valve plug 5. The pump piston 3 can now only make a small twist action, which is limited by the torsion of the coil piston spring so that an oppositely laid out arrangement for the inlet and outlet control in accord with FIG. 4*a* and FIG. 4*b* is possible.

Figure 6:
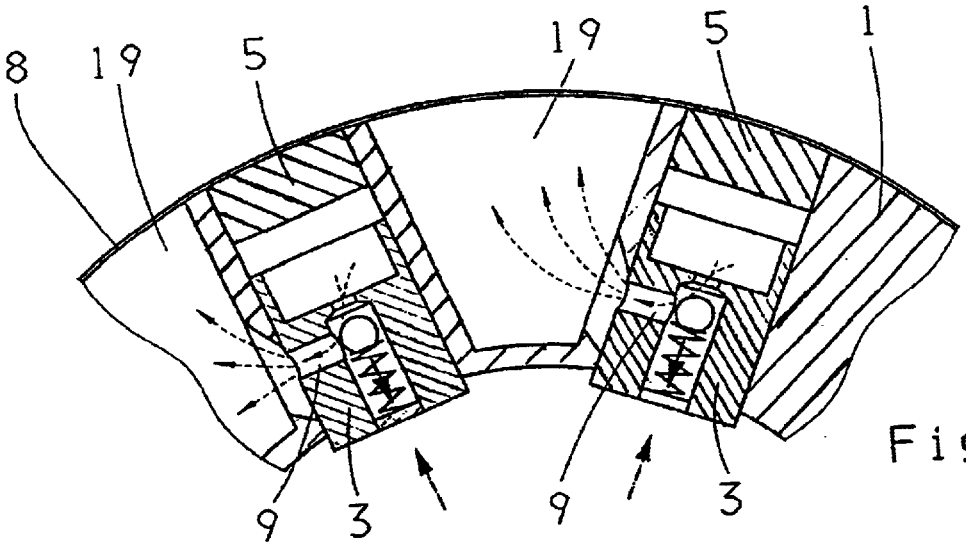
FIGS. 6, 7 show partial sections through two further invented embodiments.

FIG. 6 shows an embodiment of an invented radial piston pump with an outlet control in which voids 19 have been created between the upper section of the cylinder bore 2 in the pump housing 1 into which the passage 9 in the pistons 3 opens. This void 19, which communicates with the storage space, can serve as a quieting region for the emerging pressurized fluid, whereby construction space for the design of the storage space can be economized, insofar such a saving is necessary.

Figure 7:
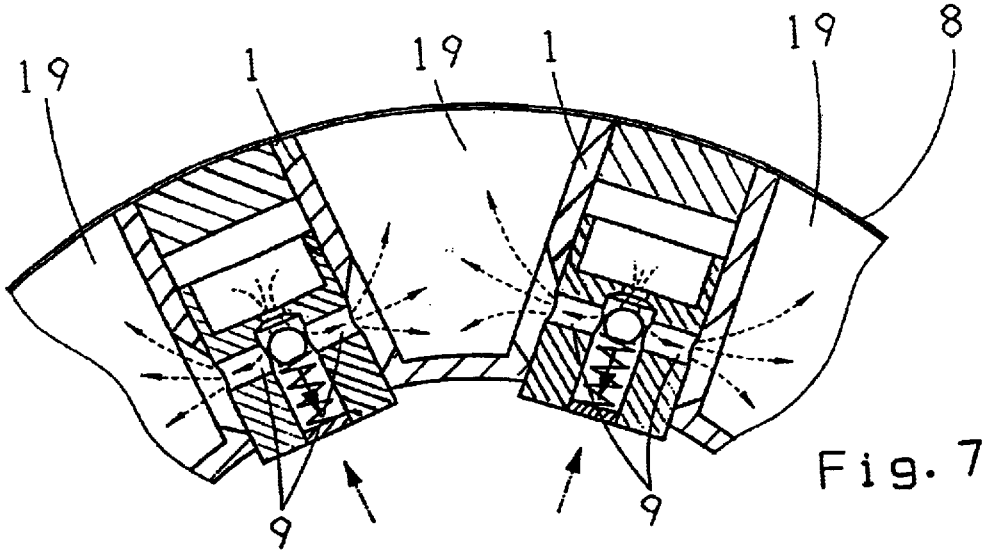

FIG. 7 shows an improvement of the radial piston pump, as shown in FIG. 6, whereby one intervening void 19 is provided between respective neighboring cylinder bores. Also, the passage 9 in each piston 3 is provided with two outlet openings which lies diametrically opposite to one another. This arrangement allows that each said outlet opening to respectively connect to one of the two neighboring voids 19.

In accord with the invention, the control for the outlet and for the inlet for the fluid can be effected by an appropriate arrangement of the pump piston, wherein even a combined outlet/inlet control can be brought about by the use of an acceleration principle in a single pump piston.

The capability for adjustment of these two controls is done by springs, by the weight of the ball (or a corresponding component), corresponding in size and the shape for the specific use.

The twist securement of the piston assures a failure-free function. The space between two neighboring cylinder bores is utilized as an additional storage space, whereby the outlet from each cylinder bore can be found only on one or on two sides.

An optimization of the hydraulic-mechanical characteristics of the pump, by means of the invented inlet control, leads to:

- a reduction in the pressure pulsation,
- an increase in the pumped flow of the radial piston pump given an equal geometric layout,
- contributes to a better cold start-up behavior by opening the suction side inlets during the entire suction stroke, and a small required suction pressure, and
- a reduction of the noise level by the optimization of the pressure curve in the cylinder (optimization of the pressure curve in the suction stroke by lessening the necessary negative pressure by the simultaneous lengthening of the suction time; optimization of the pressure curve in the pressure stroke by reducing the rate of pressure increase in the cylinder).

REFERENCE NUMBER AND PARTS

1 pump body
2 cylinder bores, a plurality thereof in body 1
3 pistons, set in the cylinder bores 2
4 springs, loading said pistons 4
5 valve plugs
6 a cam, driving said pistons 4
7 annual suction channel for inlet of oil, and
8 band spring to close opening in plug 5.
9 passage, in the piston
10 ball, a first
11 outlet
12 inlet
13 spring to load ball
14 channel inlet
15 ball, a second
16 piston coil spring
17 spring end point, anti-piston-twist
18 spring end point for anchorage
19 void, between cylinders

What is claimed is:

1. A radial piston pump comprising a pump body having a plurality of cylinder bores formed therein and a pump piston being located within each respective one of the cylinder bores, each one of the pump pistons being driven by a cam, and each of the cylinder bores communicating with a fluid inlet and a fluid outlet;

wherein each one of the pump pistons (3) has an arrangement for controlling at least one of fluid entering the cylinder bore, through the fluid inlet, and fluid exiting the cylinder bore, through the fluid outlet; and a piston coil spring (16) is inserted, between an upper end of the pump piston (3) and a lower end of a valve plug (5) and the piston coil spring (16) is anchored to both the pump piston (3) and the valve plug (5) to minimize rotation of the pump piston (3) about a longitudinal axis thereof during operation of the radial piston pump.

2. The radial piston pump according to claim 1, wherein the arrangement comprises at least one check valve which has at least one passage (9) formed in the pump piston (3) which connects, in one position of the piston pump (3), the fluid inlet (12) with the fluid outlet (11).

3. The radial piston pump according to claim 2, wherein the check valve is a ball (10) which is biased by a coil spring (13), and the ball (10) is axially movable between a closed position, for closing a fluid passage (9), and an opened position for opening the fluid passage (9).

4. The radial piston pump according to claim 1, wherein a respective void (19) is provided in the pump body (1) between a radially outward lying section of each adjacent pair of cylinder bores (2), and a fluid passage (9) outlet of each of the adjacent pair of cylinder bores (2) communicates with the respective void (19).

5. The radial piston pump according to claim 1, wherein the arrangement comprises a pair of check valves, one of the pair of check valves includes a passage (9) formed in the pump piston (3) which connects, in an open position of the one of the pair of check valves, the fluid outlet (11) with fluid located within the respective cylinder bore.

6. The radial piston pump according to claim 1, wherein each of the pair of check valves comprises a ball (10), and at least one of the balls (10) is biased by a coil spring (13) into a closed position, and the ball (10) is axially movable between the closed position, which prevents fluid flow through the fluid passage (9), and an opened position, which permits fluid flow through the fluid passage (9).

7. A radial piston pump comprising a pump body having a plurality of cylinder bores formed therein and a pump piston being located within each respective one of the cylinder bores, each one of the pump pistons being driven by a cam, and each of the cylinder bores communicating with a fluid inlet and a fluid outlet;

wherein each one of the pump pistons (3) has an arrangement for controlling both fluid entering the cylinder bore, through the fluid inlet, and fluid exiting the cylinder bore, through the fluid outlet; and the arrangement comprises a pair of check valves, one of the pair of check valves includes a passage (9) formed in the pump piston (3) which connects, in an open position of the one of the pair of check valves, the fluid outlet (11) with fluid located within the respective cylinder bore.

8. The radial piston pump according to claim 7, wherein each of the pair of check valves comprises a ball (10), and at least one of the balls (10) is biased by a coil spring (13) into a closed position, and the ball (10) is axially movable between the closed position, which prevents fluid flow through the fluid passage (9), and an opened position, which permits fluid flow through the fluid passage (9).

9. A radial piston pump comprising a pump body having a plurality of cylinder bores formed therein and a pump piston being located within each respective one of the cylinder bores, a respective valve plug (5) sealing an open end of each one of cylinder bores with a band (8) surrounding the radial piston pump and communicating with each one of the valve plugs (5), the each one of the pump pistons being driven by a cam, and each of the cylinder bores communicating with a fluid inlet and a fluid outlet;

wherein each one of the pump pistons (3) has an arrangement for controlling both fluid entering the cylinder bore, through the fluid inlet, and fluid exiting the cylinder bore, through the fluid outlet and being exhausted around the band (8).

10. The radial piston pump according to claim 9, wherein a first end of the fluid outlet communicates with a passage formed in a side wall of the piston and a second opposite end of the fluid outlet communicates with the band (8).

11. The radial piston pump according to claim 9, wherein the arrangement comprises a pair of check valves, one of the pair of check valves includes a passage (9) formed in the pump piston (3) which connects, in an open position of the one of the pair of check valves, the fluid outlet (11) with fluid located within the respective cylinder bore.

12. The radial piston pump according to claim 11, wherein each of the pair of check valves comprises a ball (10), and a first ball (10) is biased by a coil spring (13) into a closed position, and the first ball (10) is axially movable between the closed position, which prevents fluid flow through the fluid passage (9), and an opened position, which permits fluid flow through the fluid passage (9).

13. The radial piston pump according to claim 12, wherein during a suction stroke of the radial piston pump, the first ball seals a flow passage while the second ball is unseated and permits fluid flow into the cylinder bore, and, during a pump stroke of the radial piston pump, the second ball seals a flow passage into the cylinder bore while the first ball is unseated and permits fluid flow out of the cylinder bore.

14. The radial piston pump according to claim 9, wherein the fluid outlet is formed in the valve plug (5) and a first end of the fluid outlet communicates with an interior of the cylinder bore and a second opposite end of the fluid outlet communicates with the band (8).

* * * * *